US007451519B2

(12) United States Patent
Nishinaka et al.

(10) Patent No.: US 7,451,519 B2
(45) Date of Patent: Nov. 18, 2008

(54) SHEET HOLDING STRUCTURE AND CLEANER HAVING THE SAME

(75) Inventors: Noboru Nishinaka, Wakayama (JP); Kiyoshi Ishii, Hyogo (JP)

(73) Assignee: Sharp Kabushiki Kaisha, Osaka (JP)

( * ) Notice: Subject to any disclaimer, the term of this patent is extended or adjusted under 35 U.S.C. 154(b) by 539 days.

(21) Appl. No.: 11/201,701

(22) Filed: Aug. 11, 2005

(65) Prior Publication Data

US 2006/0090279 A1 May 4, 2006

(30) Foreign Application Priority Data

Oct. 29, 2004 (JP) ..... 2004-314929

(51) Int. Cl.
*A47L 13/46* (2006.01)
*A47L 13/256* (2006.01)

(52) U.S. Cl. ..... 15/231

(58) Field of Classification Search ..... 15/231
See application file for complete search history.

(56) References Cited

U.S. PATENT DOCUMENTS

| | | | | |
|---|---|---|---|---|
| 3,099,855 | A * | 8/1963 | Nash | 15/231 |
| 3,827,100 | A * | 8/1974 | Griffin et al. | 15/229.2 |
| 6,484,346 | B2 | 11/2002 | Kingry et al. | |
| 2002/0194693 | A1 * | 12/2002 | Wu | 15/322 |

FOREIGN PATENT DOCUMENTS

| | | |
|---|---|---|
| JP | 3023167 | 1/1996 |
| JP | 08-154883 | 6/1996 |
| JP | 10-005164 | 1/1998 |
| JP | 3050915 | 5/1998 |
| JP | 2001-104228 | 4/2001 |
| JP | 2002-143065 | 5/2002 |
| JP | 3519394 | 2/2004 |
| WO | 01/12052 | 2/2001 |
| WO | 01/12052 A1 | 2/2001 |

OTHER PUBLICATIONS

Office Action and English translation thereof for corresponding Japanese Application No. 2004-314929 dated Jun. 26, 2007.
Office Action and English summary thereof for corresponding Chinese Patent Application No. 2005-10118451.6 dated May 30, 2008.
Office Action and English transaction thereof for corresponding Japanese Patent Application No. 2004-314929 dated Apr. 15, 2008.

* cited by examiner

*Primary Examiner*—Randall Chin
(74) *Attorney, Agent, or Firm*—Renner, Otto, Boisselle & Sklar, LLP

(57) ABSTRACT

There is provided a sheet holding structure in which a sheet holding force can be increased, and a cleaner having the structure. The sheet holding structure includes a base material made of a flexible material and having main surfaces, and a slit formed in the main surfaces of the base material. The slit includes a curved slit, and a plurality of protruding slits spaced from each other in a direction along the curved slit, connected to a protruding portion-side forming edge of the curved slit, and protruding and extending from the protruding portion-side forming edge of the curved slit. A part of the base material surrounded by the curved slit is bent and a part of the sheet placed on one of the main surfaces of the base material is inserted into the curved slit and the protruding slits and locked to thereby hold the sheet.

7 Claims, 7 Drawing Sheets

SHEET HOLDING STRUCTURE AND CLEANER HAVING THE SAME

BACKGROUND OF THE INVENTION

1. Field of the Invention

The present invention relates generally to a sheet holding structure for holding a sheet-shaped object such as fabric and paper and particularly to a sheet holding structure mounted to a cleaning head portion of a cleaner to hold the sheet in order to wipe a floor surface.

2. Description of the Background Art

A cleaner such as a mop to which a sheet of woven or nonwoven fabric is mounted and held is conventionally known. There is a structure for holding a sheet on the cleaner as described in International Publication No. WO01/12052 (Japanese Patent No. 3519394), for example.

The cleaner having a sheet holding structure portion and described in the foregoing publication includes a handle, a cleaning head mounted to the handle, and at least one holding structure portion disposed on the cleaning head to hold a sheet by receiving a sheet at a periphery of the cleaning head. The holding structure portion is made of a flexible material and includes a base triangular portion having an apex and a plurality of pie-shaped portions with their apexes meeting at a common point at a distance from the apex of the base triangular portion and close to a side portion of the base triangular portion. Respective two side portions of the base triangular portion and the pie-shaped portions are defined by slits formed to pass through the flexible material. The base triangular portion and the pie-shaped portions are bent respectively to hold the sheet.

In the sheet holding structure described in the forgoing publication, however, the sheet is disadvantageously detached during use of the cleaner in some cases, and a holding force for fixing the sheet to the periphery of the cleaning head is insufficient. Not only in a case of the dry sheet but also in a case in which a wet sheet impregnated with a liquid for wiping dust off is fixed to the periphery of the cleaning head, a sufficient holding force cannot be obtained; therefore, the sheet is advantageously detached from the cleaning head during use of the cleaner in some cases.

SUMMARY OF THE INVENTION

Therefore, an object of the present invention is to provide a sheet holding structure in which a sheet holding force can be increased, and a cleaner having the same.

A sheet holding structure according to the present invention includes a base material made of a flexible material and having main surfaces, and a slit formed in the main surfaces of the base material. The slit includes a curved slit, and a plurality of protruding slits spaced from each other in a direction along the curved slit, connected to a protruding portion-side forming edge of the curved slit, and protruding and extending from the protruding portion-side forming edge of the curved slit. A part of the base material surrounded by the curved slit is bent and a part of a sheet placed on one of the main surfaces of the base material is inserted into the curved slit and the protruding slits and locked to thereby hold the sheet.

In the sheet holding structure according to the present invention, a part of the sheet placed on one of the main surfaces of the base material is inserted into the curved slit and locked. The part of the sheet inserted into the curved slit is also inserted into and pinched in the plurality of protruding slits protruding from the protruding portion-side forming edge of the curved slit and locked. As compared with the conventional sheet holding structure in which the side portions of the base triangular portion are formed of straight slits, the part of the sheet inserted into the slit is inserted into the curved slit and also inserted into the plurality of protruding slits spaced from each other and extending separately and locked. As a result, the sheet is held more firmly.

In the sheet holding structure according to the present invention, preferably, a protruding edge portion protruding toward the protruding portion-side forming edge is formed at a recessed portion-side forming edge of the curved slit.

In this case, because a part of the sheet inserted into the curved slit is engaged with the protruding edge portion, the sheet holding force can further be increased.

In this case, preferably, the plurality of protruding edge portions are formed at the recessed portion-side forming edge of the curved slit and respectively protrude to extend in directions in which the plurality of protruding slits protrude respectively. In this case, because the plurality of protruding edge portions are formed to correspond to the plurality of protruding slits, respectively, the part of the sheet inserted into the curved slit is engaged with the protruding edge portions and a part of the engaged sheet is inserted into the protruding slits and locked. Therefore, with interaction between the curved slit and the protruding slits through the protruding edge portions, the sheet holding force can further be increased.

In the sheet holding structure according to the present invention, preferably, a protrusion is formed in a vicinity of the forming edge of the curved slit or forming edges of the protruding slits on the other main surface of the base material.

In this case, because a part of the sheet inserted into the curved slit or the protruding slits and locked is engaged with the protrusion on the other main surface of the base material, the sheet holding force can be increased more effectively.

In the sheet holding structure according to the present invention, preferably, an area of the base material surrounded by the curved slit is of about a size of a fingertip of a human hand.

In this case, by pressing the part of the sheet placed on the one main surface of the base material from above the area of the base material surrounded by the curved slit with the fingertip, the part of the sheet can be inserted into the curved slit. Therefore, it is possible to easily insert the sheet into the curved slit to hold the sheet without hurting the fingertip upon inserting the sheet.

In the sheet holding structure according to the present invention, preferably, a rising wall portion curved along a shape of the curved slit is formed in an area of the base material surrounded by the curved slit on the other main surface of the base material.

In this case, the areas of the base material on the recessed and protruding sides of the curved slit can be molded while kept substantially parallel to each other. Moreover, molding strength of the area of the base material surrounded by the curved slit can be increased.

In the sheet holding structure according to the present invention, preferably, the protruding portion side of the curved slit is oriented in a direction of tension applied to the sheet.

In this case, even if the tension is applied to the sheet when the sheet is held with the part of the sheet locked to the curved slit, it is possible to effectively prevent the sheet from being detached from the slit.

The sheet holding structure according to the present invention preferably includes the plurality of slits.

In this case, the part of the sheet can be inserted into the slit and locked at each of the plurality of positions such as one and the other end portions of the sheet to thereby enhance the sheet holding force.

A cleaner according to the present invention includes a handle portion, a cleaning head portion mounted to the handle portion, and a holding structure portion disposed at the cleaning head portion to hold a sheet in such a manner that the sheet covers at least a part of a periphery of the cleaning head portion. The holding structure portion includes at least one of the foregoing sheet holding structures.

In this case, it is possible to easily attach the sheet for wiping off dust and the like to the cleaning head portion. It is possible to enhance the holding force for fixing not only the dry sheet but also the wet sheet impregnated with liquid for wiping off dust and the like or lubricant to the periphery of the cleaning head portion to thereby prevent the sheet from being detached from the cleaning head portion during use of the cleaner.

Preferably, the cleaner according to the present invention includes at least the two sheet holding structures so that one and the other end portions of the sheet are locked, recessed portion sides of the curved slits forming the two sheet holding structures face each other, and the protruding portion sides face outer sides of the cleaning head portions.

In this case, it is possible to prevent the sheet from being detached due to tension applied to the sheet from the direction along the cleaning direction as a result of friction between a face to be cleaned and a face of the sheet wrapped around the cleaning head portion.

As described above, according to the present invention, the sheet holding force can be increased.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention will be described below by way of an example in which a sheet holding structure is applied to a wiping cleaner including a suction portion as a cleaner based on the drawings.

Figure 1:
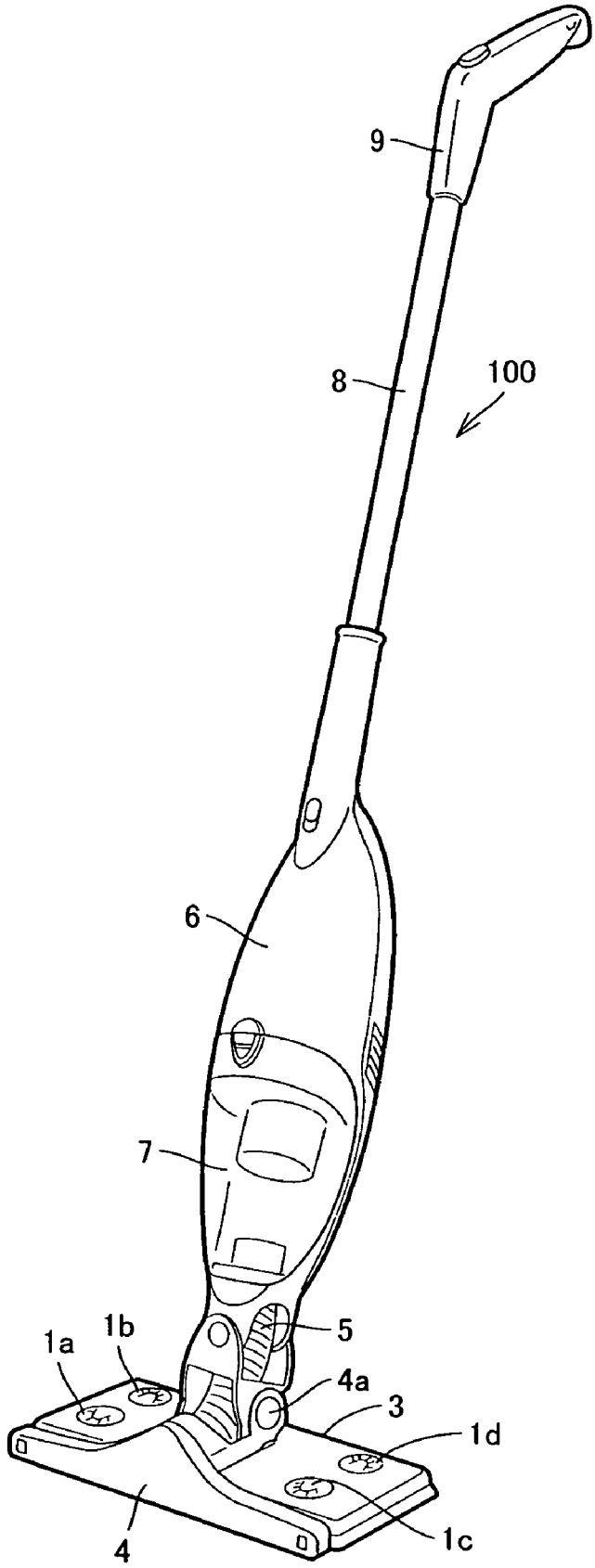
FIG. 1 is a perspective view of a cleaner including a sheet holding structure as an embodiment of the present invention.

As shown in FIG. 1, the wiping cleaner 100 includes a wiping head 3 as a cleaning head portion, a suction nozzle 4 mounted to one side, e.g., a front side of the wiping head 3, a dust container 7 for storing dirt and dust sucked from the suction nozzle 4 through a hose 5, a main body 6 for retaining the dust container 7 and housing a suction driving portion and the like, and a handle 9 as a handle portion connected to the main body 6 through a connecting pipe 8 to operate the wiping head 3. The wiping head 3 is connected and mounted to the handle 9 through the main body 6 and the connecting pipe 8. The suction nozzle 4 is mounted to mounting holes 4*a* and 4*b* (FIG. 3) to turn with respect to the main body 6.

On a surface of the wiping head 3, four sheet holding structures 1*a*, 1*b*, 1*c* and 1*d*, for example, are arranged and mounted.

Figure 2A:
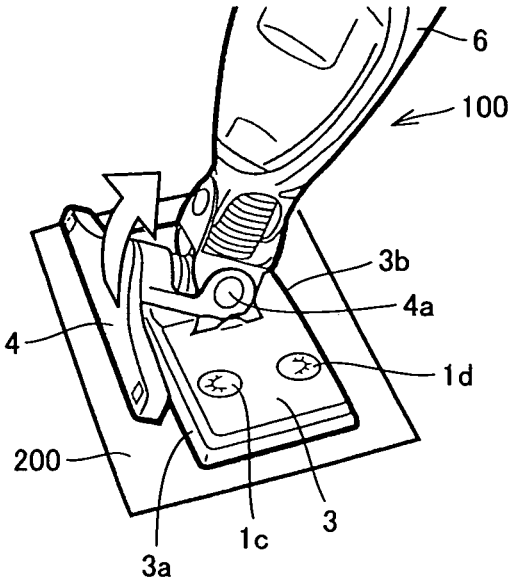
FIGS. 2A and 2B are partial perspective views showing a procedure for attaching a sheet to a cleaning head portion in the cleaner of the embodiment of the present invention.

As shown in FIG. 2A, the suction nozzle 4 is turned upward toward the main body 6 as shown with an arrow to expose one head outer side face 3*a* in a direction along a wiping direction of the wiping head 3. Then, the wiping head 3 of the wiping cleaner 100 is placed on a spread sheet 200 so as to bring a lower face of the wiping head 3 in contact with the sheet 200.

Figure 2B:
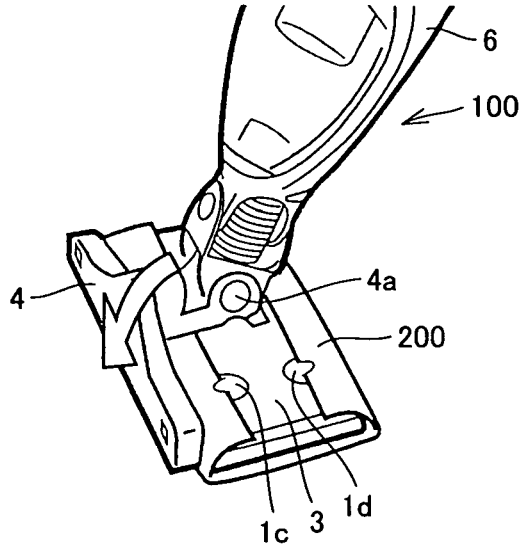

Then, as shown in FIG. 2B, one and the other end portions of the sheet 200 are folded back so that the sheet 200 covers a lower face of the wiping head 3, the one head outer side face 3*a*, and the other head outer side face 3*b* to cover at least a part of a periphery of the wiping head 3, and four portions of the sheet 200 are inserted into the sheet holding structures 1*a*, 1*b*, 1*c* and 1*d* to be held by the wiping head 3. Then, as shown with an arrow, the suction nozzle 4 is turned downward away from the main body 6 and toward the one head outer side face 3*a* and returned to an initial position. Thus, the sheet 200 is mounted to and held by the wiping head 3.

Figure 3:
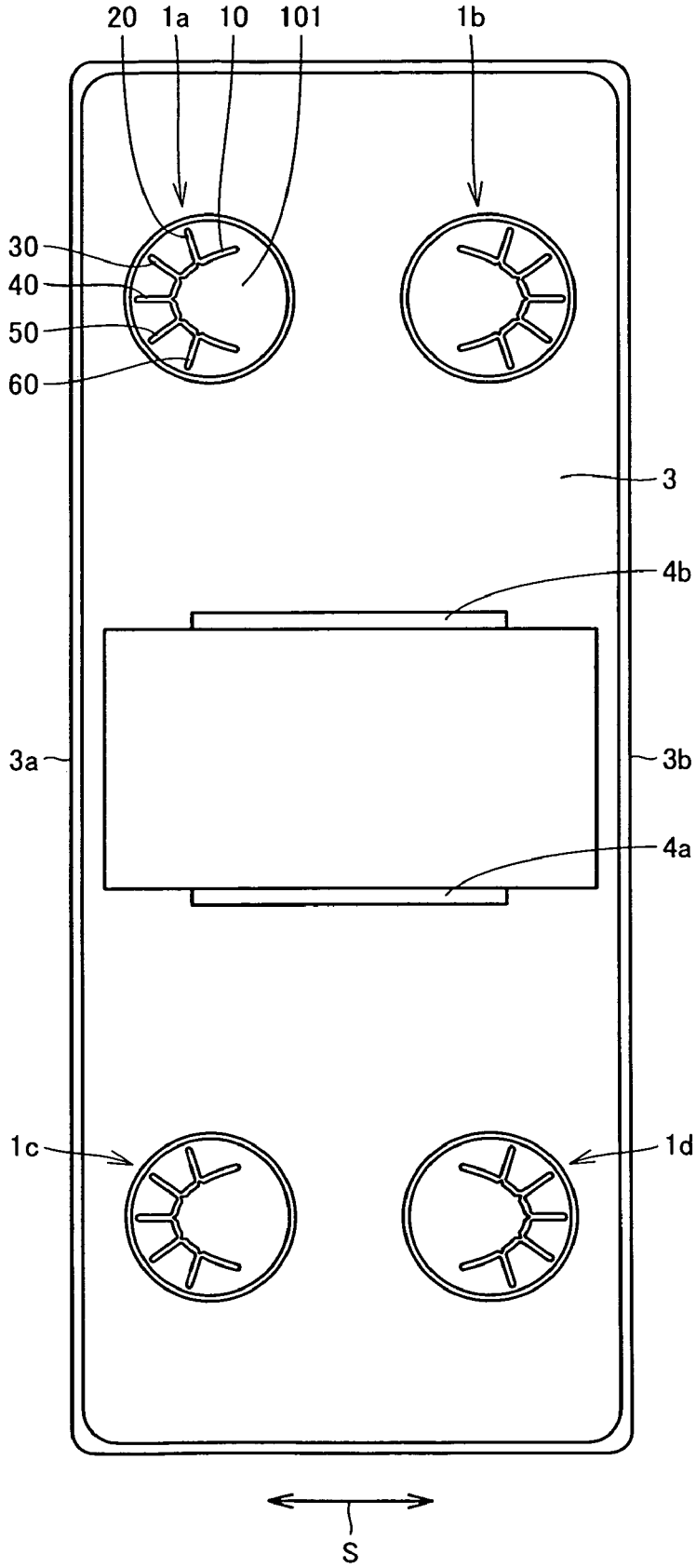
FIG. 3 is a partial plan view of the cleaning head portion in the cleaner of the embodiment of the present invention.

As shown in FIG. 3, the two sheet holding structures 1*a* and 1*b* are arranged on the surface of the wiping head 3 to face each other in a wiping direction S of the wiping head 3 shown with an arrow so that the one and the other end portions of the sheet 200 can be inserted into and locked to the sheet holding structures 1*a* and 1*b*. Likewise, in a direction orthogonal to the wiping direction S of the wiping head 3, the two sheet holding structures 1*c* and 1*d* are arranged in positions facing the two sheet holding structures 1*a* and 1*b* on the surface of the wiping head 3. In other words, the four sheet holding structures 1*a*, 1*b*, 1*c* and 1*d* are arranged uniformly in four corners of a surface area of the rectangular wiping head 3.

Each of the four sheet holding structures 1*a*, 1*b*, 1*c* and 1*d* includes a base plate 101 as a base material made of a flexible material such as soft synthetic resin, e.g., polyethylene, elastomer and the like and having main surfaces, and a slit formed in the main surfaces of the base plate 101. The slit includes a curved slit 10, and a plurality of (five, for example) protruding slits 20, 30, 40, 50 and 60 spaced from each other in a direction along the curved slit 10, connected to a protruding portion-side forming edge of the curved slit 10, and protruding and extending from the protruding portion-side forming edge of the curved slit 10. A portion of the base plate 101 surrounded by the curved slit 10 is formed to be bent.

The curved slits 10 forming the respective slits of the four sheet holding structures 1*a*, 1*b*, 1*c* and 1*d* are arranged so that their recessed portion sides face each other and that their protruding portion sides face the head outer side faces 3*a* and 3*b* of the wiping head 3. Thus, the protruding portion sides of the curved slits 10 are arranged in an orientation of a direction of a tension applied to the sheet 200 from a direction along the wiping direction S of the wiping head 3.

Figure 4:
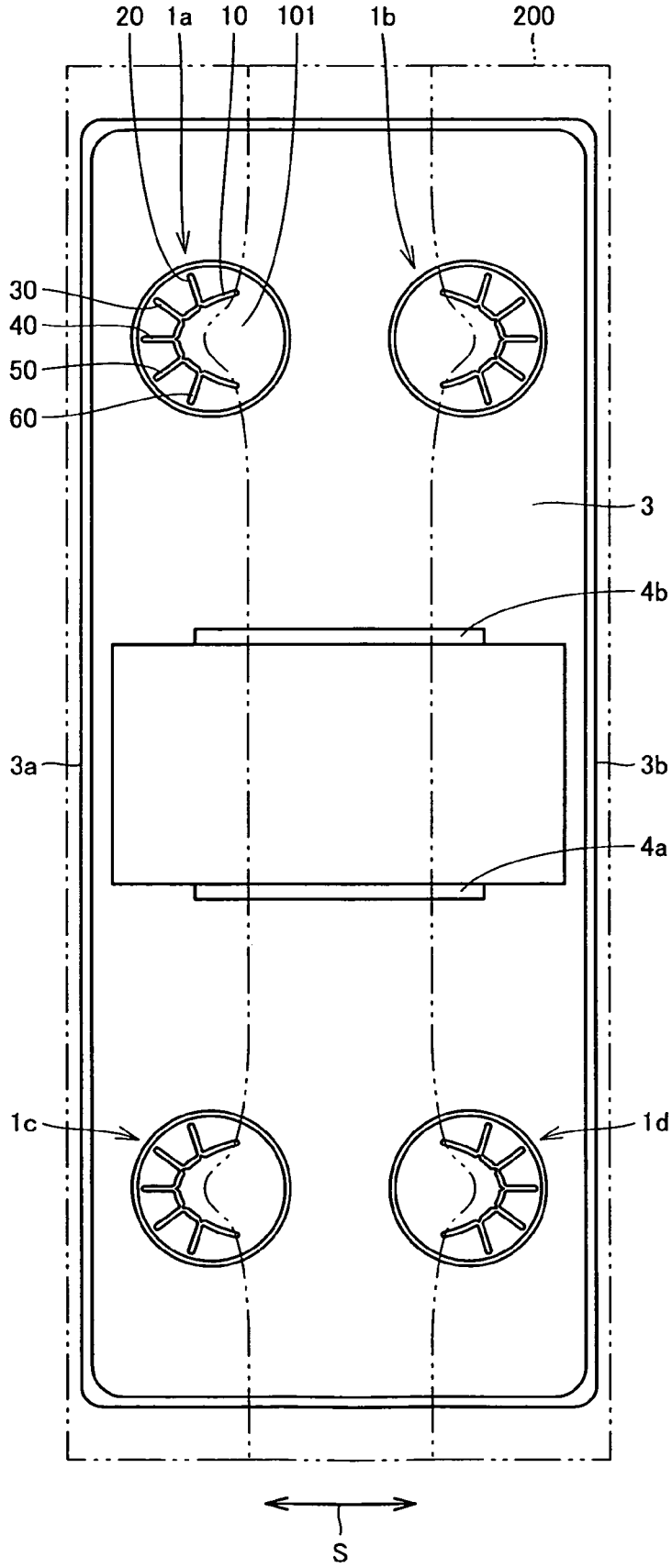
FIG. 4 is a partial plan view of the cleaning head portion which is partially covered with the sheet in the cleaner of the embodiment of the present invention.

As shown in FIG. 4, the portions of the base plate 101 surrounded by the respective curved slits 10 of the four sheet holding structures 1*a*, 1*b*, 1*c* and 1*d* are bent and the four portions at one and the other end portions of the sheet 200 (shown in two-dot chain lines) are inserted into the curved slits 10 and the protruding slits 20, 30, 40, 50 and 60 and locked. Thus, a part of the sheet 200 placed on the one main surface of the base plate 101 is held at four positions of the wiping head 3.

Figure 5:
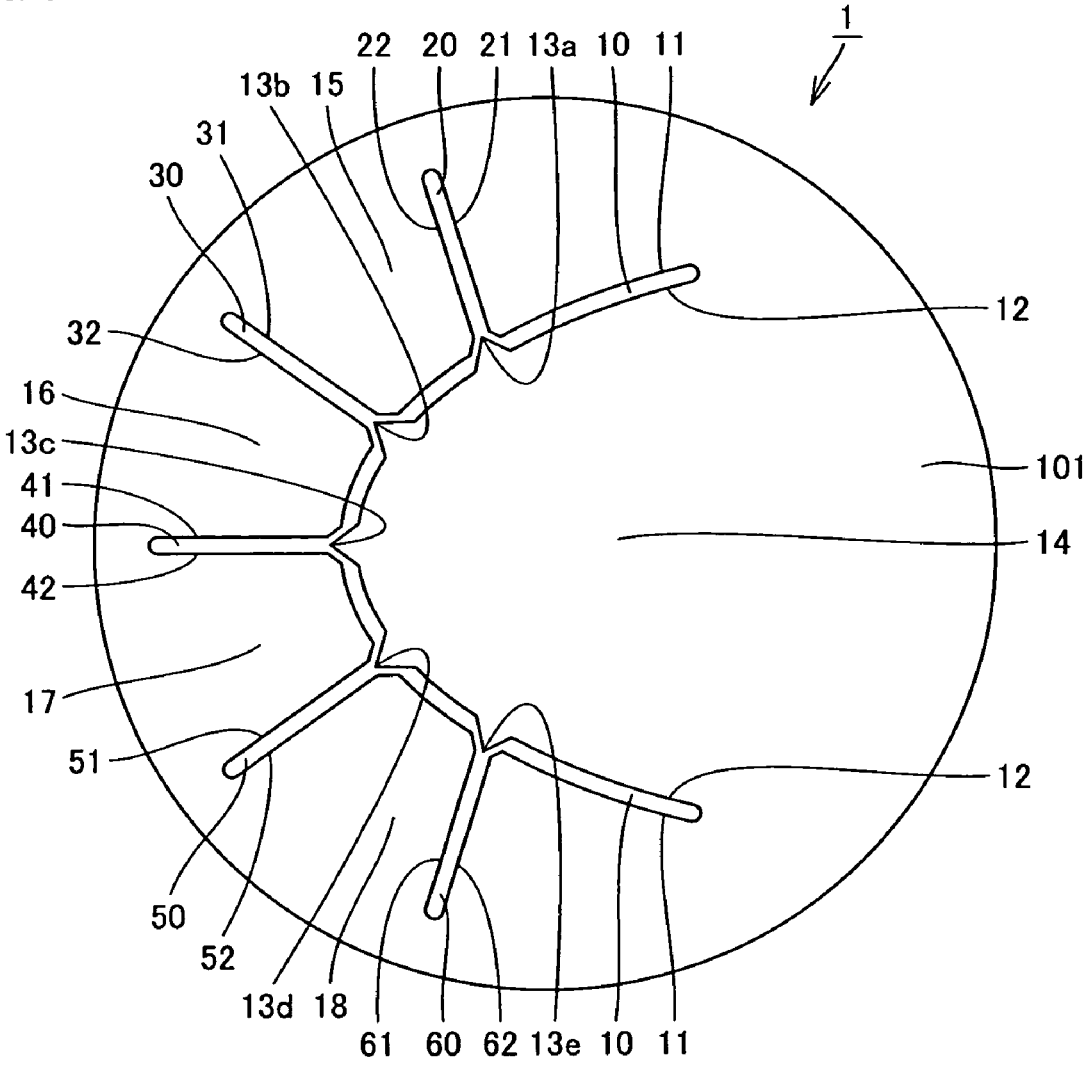
FIG. 5 is a top view of an upper face (surface) of the sheet holding structure as the embodiment of the present invention.

As shown in FIG. 5, in the base plate 101 of the sheet holding structure 1, a slit formed of the curved slit 10 formed along a U-shaped curve and the five protruding slits 20, 30, 40, 50 and 60 connected to the curved slit 10, extending from the curved slit 10, and protruding like branches is formed, for example. To be specific, the respective protruding slits 20, 30, 40, 50 and 60 are spaced from each other along the curved slit 10, connected to a curved slit forming edge 11 as a protruding portion-side forming edge of the curved slit 10 and protruding and extending from the curved slit forming edge 11. With the protruding slits 20, 30, 40, 50 and 60, trapezoidal locking portions 15, 16, 17 and 18 are formed. A size of a clearance of the slit formed of the curved slit 10 and the protruding slits 20, 30, 40, 50 and 60 is preferably about 0.8 to 1.0 mm, for example. Moreover, the protruding slits are preferably formed so that about four to six trapezoidal locking portions are formed separately.

At a curved slit forming edge 12 representing a recessed portion-side forming edge of the curved slit 10, five protruding edges (protruding angle portions 13*a*, 13*b*, 13*c*, 13*d* and 13*e* representing protruding edge portions protruding toward the curved slit forming edge 11 form substantially triangular apexes, for example. To be more specific, the respective five protruding edges 13*a*, 13*b*, 13*c* and 13*e* protrude to extend in directions in which the respective five protruding slits 20, 30, 40, 50 and 60 protrude.

An area of the base plate 101 surrounded by the curved slit 10 forms a fingertip-shaped pressing portion (locking portion) 14 substantially of a size of a tip of a human thumb, forefinger, or the like.

Figure 6:
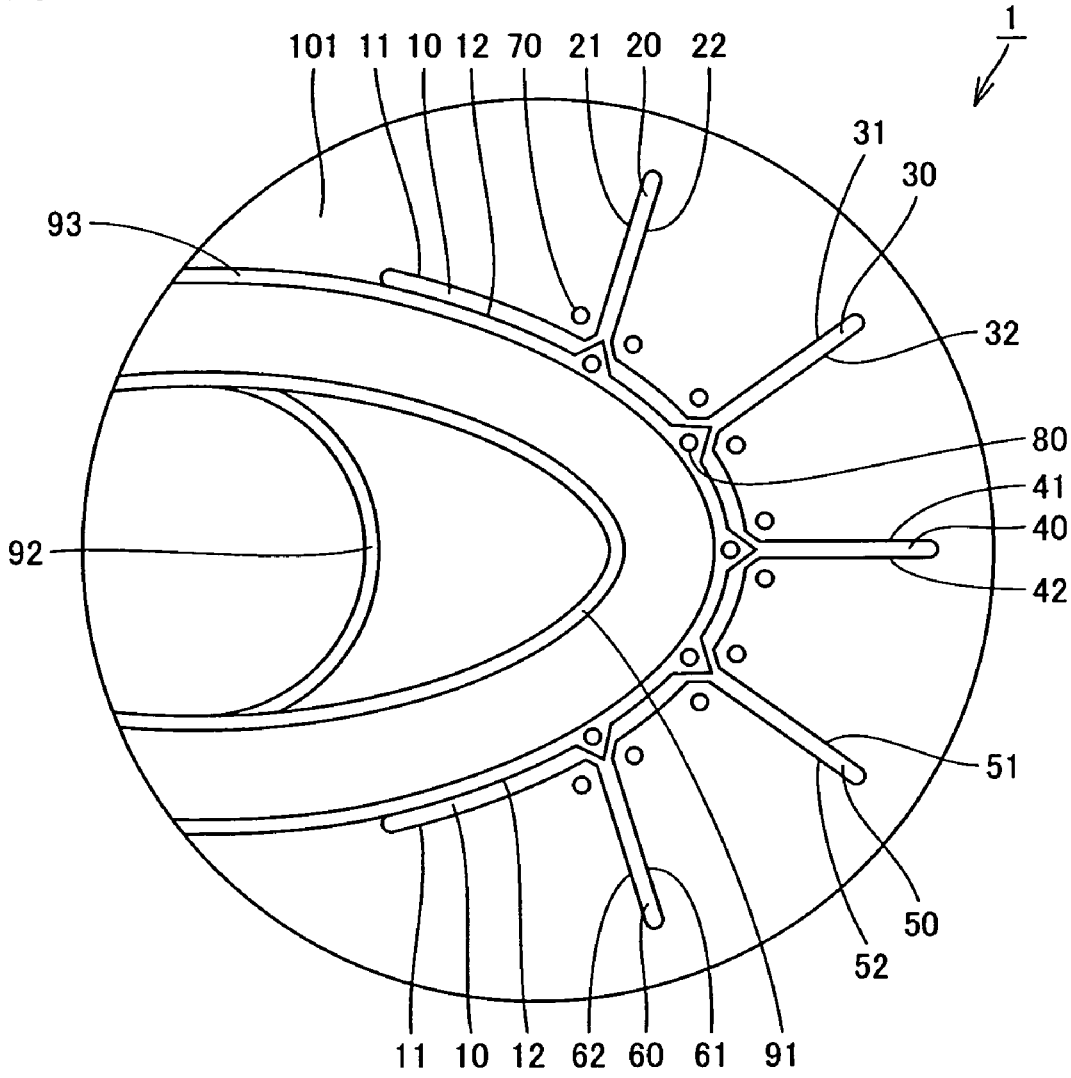
FIG. 6 is a bottom view of a lower face (back face) of the sheet holding structure as the embodiment of the present invention.

As shown in FIG. 6, in a back face of the base plate 101 forming the sheet holding structure 1 as the other main surface of the base material, a plurality of circular cylindrical protrusions 70 as protrusions are formed in a vicinity of the curved slit forming edge 11 of the curved slit 10 and a plurality of circular cylindrical protrusions 80 are formed in a vicinity of the curved slit forming edge 12. To be more specific, the plurality of circular cylindrical protrusions 70 are respectively disposed and formed in vicinities of an intersection of the curved slit forming edge 11 and a protruding slit forming edge 21, an intersection of the curved slit forming edge 11 and a protruding slit forming edge 22, an intersection of the curved slit forming edge 11 and a protruding slit forming edge 31, an intersection of the curved slit forming edge 11 and a protruding slit forming edge 32, an intersection of the curved slit forming edge 11 and a protruding slit forming edge 41, an intersection of the curved slit forming edge 11 and a protruding slit forming edge 42, an intersection of the curved slit forming edge 11 and a protruding slit forming edge 51, an intersection of the curved slit forming edge 11 and a protruding slit forming edge 52, an intersection of the curved slit forming edge 11 and a protruding slit forming edge 61, and an intersection of the curved slit forming edge 11 and a protruding slit forming edge 62. The plurality of circular cylindrical protrusions 80 are respectively formed in vicinities of the protruding edges 13*a*, 13*b*, 13*c*, 13*d* and 13*e* on the curved slit forming edge 12.

On the back face of the base plate 101 forming the sheet holding structure 1 as the other main surface of the base material, a rising wall portion (vertical rib) curved along a shape of the curved slit 10 is formed and a rising wall portion 91 is formed, for example, in the area of the base plate 101 surrounded by the curved slit 10. A rising wall portion 92 is formed to be connected to the rising wall portion 91. A rising wall portion 93 is formed along the curved slit forming edge 12. The rising wall portions 91 and 92 form relatively high vertical walls, and the rising wall portion 93 forms relatively low vertical wall.

In the sheet holding structure 1 formed as described above, the part of the sheet 200 placed on the one main surface of the base plate 101 is inserted into the curved slit 10 and locked and a part of the sheet 200 inserted into the curved slit 10 is also inserted into and pinched in the protruding slits 20, 30, 40, 50 and 60 protruding from the curved slit forming edge 11 and locked. As compared with the conventional sheet holding structure in which the side portions of the base triangular portions are formed of straight slits, the part of the sheet 200 inserted into each slit is inserted into the curved slit 10 and also inserted into the protruding slits 20, 30, 40, 50 and 60 spaced from each other and extending separately and locked. Therefore, the sheet 200 is held more firmly. In this case, it is preferable to press a fingertip against the fingertip-shaped pressing portion 14 as the area of the base plate 101 surrounded by the curved slit 10 to insert the part of the sheet 200 into the curved slit 10 to thereby push the part of the sheet 200 to the back face sides of the trapezoidal locking portions 15, 16, 17 and 18 and pinch the part in the protruding slits 20, 30, 40, 50 and 60.

Because a part of the sheet 200 inserted into the curved slit 10 is engaged with the protruding edges 13*a*, 13*b*, 13*c*, 13*d* and 13*e*, the holding force of the sheet 200 can further be increased.

Moreover, because the respective protruding edges 13*a*, 13*b*, 13*c*, 13*d* and 13*e* are formed to correspond to the respective protruding slits 20, 30, 40, 50 and 60, the part of the sheet 200 inserted into the curved slit 10 is engaged with the protruding edges 13*a*, 13*b*, 13*c*, 13*d* and 13*e* and a part of the engaged sheet 200 is inserted into the respective protruding slits 20, 30, 40, 50 and 60 and locked. Therefore, with interaction between the curved slit 10 and the respective protruding slits 20, 30, 40, 50 and 60 through the protruding edges 13*a*, 13*b*, 13*c*, 13*d* and 13*e*, the holding force of the sheet 200 can further be increased.

Because a part of the sheet 200 inserted into the curved slit 10 or the respective protruding slits 20, 30, 40, 50 and 60 and locked is engaged with the circular cylindrical protrusions 70 and 80 on the back face of the base plate 101, the holding force of the sheet 200 can be increased more effectively.

As other function and effect, by pressing the part of the sheet 200 placed on the surface of the base plate 101 from above the fingertip-shaped pressing portion 14 as the area of the base material surrounded by the curved slit 10 with the fingertip, the part of the sheet 200 can be inserted into the curved slit 10. Therefore, it is possible to easily insert the sheet 200 into the curved slit 10 to hold the sheet 200 without hurting the fingertip upon inserting the sheet 200.

In this embodiment, on the back face of the base plate 101, the rising wall portions 91, 92 and/or 93 curved along the shape of the curved slit 10 are formed on the back face of the fingertip-shaped pressing portion 14 as the area of the base plate 101 surrounded by the curved slit 10. Therefore, the areas of the base plate 101 on the recessed and protruding sides of the curved slit 10 can be molded while kept substantially parallel to each other. Moreover, molding strength of the fingertip-shaped pressing portion 14 can be increased.

In this embodiment, the protruding portion of the curved slit 10 is in the orientation of the direction of the tension applied to the sheet 200. Therefore, even if the tension is applied to the sheet 200 when the sheet 200 is held with the part of the sheet 200 locked to the curved slit 10, it is possible to effectively prevent the sheet 200 from being detached from the slit.

The holding structure portion of the wiping head 3 of this embodiment is formed of the plurality of sheet holding structures 1*a*, 1*b*, 1*c* and 1*d*, i.e., includes the plurality of slits. Therefore, the part of the sheet 200 can be inserted into the slit and locked at each of the plurality of positions such as one and the other end portions of the sheet 200 to thereby increase the holding force of the sheet 200.

By applying the sheet holding structure of the present invention to the cleaner as in the foregoing embodiment, the sheet 200 for wiping off dust and the like can easily be attached to the wiping head 3. It is possible to enhance the holding force for fixing not only the dry sheet but also the wet sheet impregnated with liquid for wiping off dust and the like or lubricant to the periphery of the wiping head 3 to thereby prevent the sheet 200 from being detached from the wiping head 3 during use of the wiping cleaner 100. The sheet 200 may be in a form of woven fabric, nonwoven fabric, or the like and may be made of natural fiber such as paper, synthetic fiber, or the like. The sheet 200 may be a dry sheet or a sheet impregnated with liquid including a predetermined component for wiping off dust and the like.

Moreover, in the cleaner of the foregoing embodiment, at least two sheet holding structures 1 are provided so that the one and the other end portions of the sheet 200 are locked. The curved slits 10 forming the two sheet holding structures 1 are arranged in such a manner that the recessed portion sides of the curved slits 10 face each other and that the protruding sides face outer sides of the wiping head 3. Therefore, it is possible to prevent the sheet 200 from being detached due to tension applied to the sheet 200 from the direction along the wiping direction S as a result of friction between a face to be wiped and a face of the sheet 200 wrapped around the wiping head 3.

Figure 7:
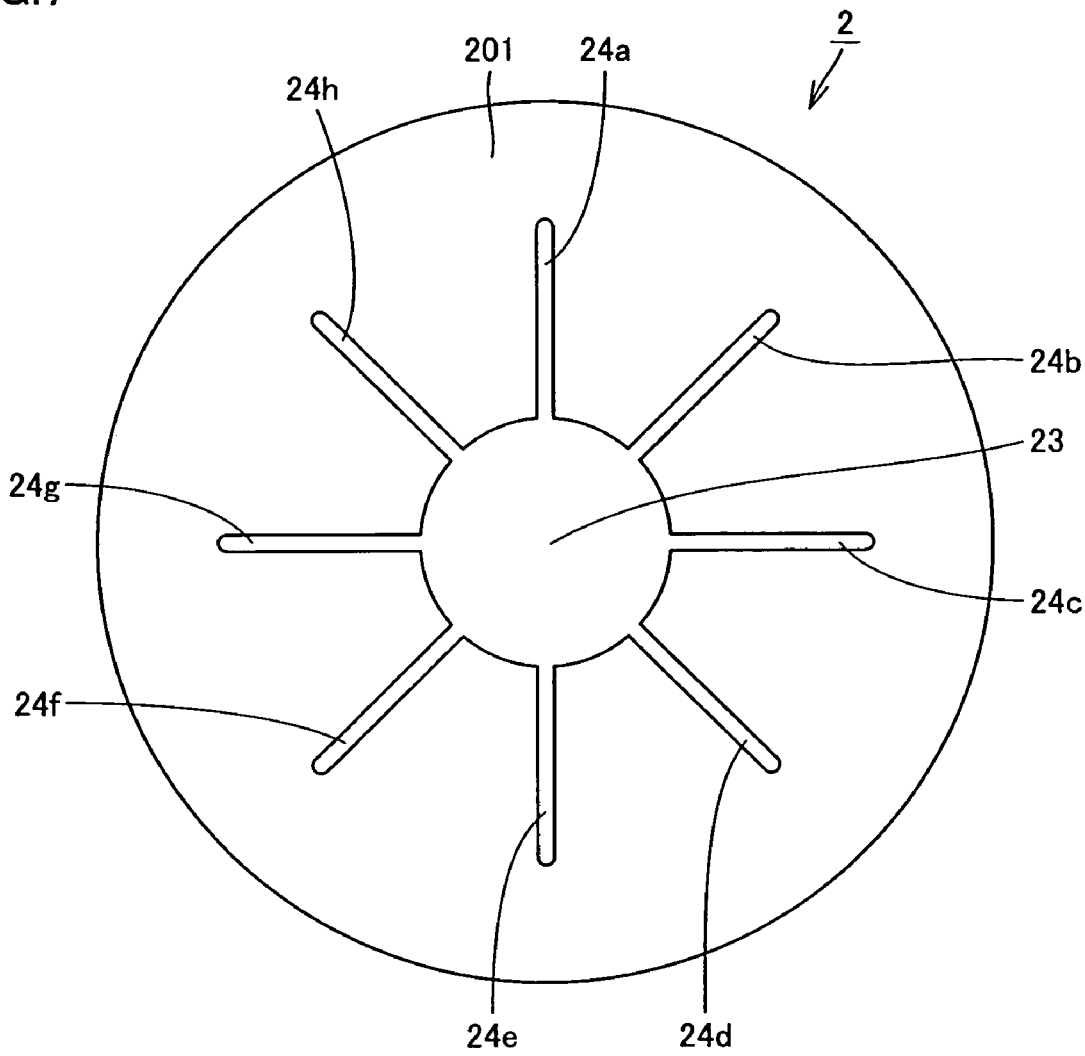
FIG. 7 is a plan view of a sheet holding structure as another embodiment.

As shown in FIG. 7, a sheet holding structure 2 as another embodiment is formed by arranging a hole 23 at a center of a base plate 201. A plurality of (e.g., about eight) radially protruding slits 24*a*, 24*b*, 24*c*, 24*d*, 24*e*, 24*f*, 24*g* and 24*h* are formed to extend radially from an outer peripheral edge of the hole 23. Between the radially protruding slits 24*a*, 24*b*, 24*c*, 24*d*, 24*e*, 24*f*, 24*g* and 24*h*, a plurality of trapezoidal locking portions are formed. A size of the hole 23 is preferably about 8 mm and a size of a clearance of each of the protruding slits 24*a*, 24*b*, 24*c*, 24*d*, 24*e*, 24*f*, 24*g* and 24*h* is preferably about 0.8 to 1.0 mm.

In other words, the sheet holding structure shown in FIG. 7 includes a base material made of a flexible material and having main surfaces, the hole and slit formed in the main surfaces of the base material. The slit includes the plurality of slits spaced from each other in a direction along a forming edge of the hole, connected to the forming edge of the hole, and protruding and extending from the forming edge of the hole. The portions of the base material formed between the plurality of slits are bent and a part of the sheet placed on one of the main surfaces of the base material is inserted into the hole and the protruding slits and locked to thereby hold the sheet.

In the sheet holding structure, the part of the sheet placed on the one main surface of the base material is inserted into the hole and locked. A part of the sheet inserted into the hole is also inserted into and pinched in the plurality of slits and locked. As compared with the conventional sheet holding structure in which the side portions of the base triangular portion are formed of straight slits, the part of the sheet inserted into the hole is also inserted into the plurality of slits spaced from each other and extending separately and locked. As a result, the sheet is held more firmly. In this case, in order to insert the part of the sheet into the hole, the part of the sheet is pushed into the hole by using a finger or a stick-shaped member such as a pencil to pinch the part of the sheet in the plurality of slits positioned around the hole. In this manner, the holding force of the sheet can be increased.

In the foregoing embodiment, the example in which the present invention is applied to the wiping cleaner including the suction portion out of the cleaners including the sheet holding structures has been described. However, also in a case of a wiping cleaner such as a mop without a suction portion and to which a sheet-shaped wiping portion such as a sheet of fabric, paper, and the like can at least be attached, by providing the foregoing sheet holding structure for holding the wiping portion, the functions and effects similar to those described above can be achieved.

In the foregoing embodiment, the example in which the present invention is applied to the cleaner including the sheet holding structure has been described. However, the present invention can widely be applied to a technical field for holding a sheet-shaped object such as a sheet of fabric, paper, and the like. For example, by applying the present invention to a holder or the like for holding fabric such as a towel on a wall or the like, a sheet holding force can be increased.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sheet holding structure comprising:

a base material made of a flexible material and having main surfaces; and a slit formed in the main surfaces of said base material, wherein said slit includes:

a curved slit; and a plurality of protruding slits spaced from each other in a direction along said curved slit, connected to a protruding portion-side forming edge of said curved slit, and protruding and extending from the protruding portion-side forming edge of said curved slit to form a plurality of trapezoidal locking portions separated by the plurality of protruding slits, wherein a part of said base material surrounded by said curved slit is bendable so that a part of a sheet placed on one of the main surfaces of said base material may be inserted into said curved slit and said protruding slits and locked to thereby hold the sheet, and a plurality of protruding edge portions having substantially triangular apexes protruding toward the protruding portion-side forming edge are formed at a recessed portion-side forming edge of said curved slit, the respective apexes protruding to extend in directions in which said plurality of protruding slits protrude.

2. The sheet holding structure according to claim 1, including an edge forming the curved slit and edges forming the protruding slits, wherein a protrusion is formed in a vicinity of the edge forming said curved slit or the edges forming said protruding slits on the main surface of said base material opposite the main surface on which the part of the sheet is placed.

3. The sheet holding structure according to claim 1, wherein an area of said base material surrounded by said curved slit is of about a size of a fingertip of a human hand.

4. The sheet holding structure according to claim 1, wherein a rising wall portion curved along a shape of said curved slit is formed in an area of said base material surrounded by said curved slit on the main surface of said base material opposite the main surface on which the part of the sheet is placed.

5. The sheet holding structure according to claim 1, wherein a protruding portion side of said curved slit defined by the protruding portion-side forming edge is oriented in a direction of tension applied to the sheet.

6. A cleaner comprising:

a handle portion;

a cleaning head portion mounted to said handle portion; and a holding structure portion disposed at said cleaning head portion to hold a sheet in such a manner that the sheet covers at least a part of a periphery of said cleaning head portion, wherein the holding structure portion includes:

a base material made of a flexible material and having main surfaces; and a slit formed in the main surfaces of said base material, said slit includes:

a curved slit; and a plurality of protruding slits spaced from each other in a direction along said curved slit, connected to a protruding portion-side forming edge of said curved slit, and protruding and extending from the protruding portion-side forming edge of said curved slit to form a plurality of trapezoidal locking portions separated by the plurality of protruding slits, wherein a part of said base material surrounded by said curved slit is bendable so that a part of a sheet placed on one of the main surfaces of said base material may be inserted into said curved slit and said protruding slits and locked to thereby hold the sheet, and a plurality of protruding edge portions having substantially triangular apexes protruding toward the protruding portion-side forming edge are formed at a recessed portion-side forming edge of said curved slit, the respective apexes protruding to extend in directions in which said plurality of protruding slits protrude.

7. The cleaner according to claim 6, comprising at least said two sheet holding structures so that one and the other end portions of the sheet are locked, wherein recessed portion sides defined by the recessed portion side forming edges of said curved slits forming said two sheet holding structures face each other and the protruding portion sides defined by the protruding portion side forming edges face outer sides of said cleaning head portions.

* * * * *